US006474601B1

(12) United States Patent
Krobusek et al.

(10) Patent No.: US 6,474,601 B1
(45) Date of Patent: Nov. 5, 2002

(54) WARREN PORTAL IDENTIFICATION AND TUNNEL RESIDENT DISGORGER SYSTEM

(76) Inventors: Richard Krobusek, 4109 Kirkwall St., Plano, TX (US) 75093-2611; David H. Hitt, 4237 Helmsley La., Plano, TX (US) 75093-3849

( * ) Notice: Subject to any disclaimer, the term of this patent is extended or adjusted under 35 U.S.C. 154(b) by 0 days.

(21) Appl. No.: 10/004,241

(22) Filed: Nov. 2, 2001

(51) Int. Cl.[7] ..... B64D 1/08
(52) U.S. Cl. ..... 244/137.4; 43/124
(58) Field of Search ..... 244/1 R, 137.4, 244/62, 53 R; 43/124, 125, 127

(56) References Cited

U.S. PATENT DOCUMENTS

| | | | | |
|---|---|---|---|---|
| 1,309,193 | A | * | 7/1919 | Garrison |
| 1,403,461 | A | * | 1/1922 | Van Meter |
| 3,666,216 | A | * | 5/1972 | Nagy et al. |
| 3,946,971 | A | * | 3/1976 | Chadwick |
| 4,553,719 | A | * | 11/1985 | Ott |
| 4,833,818 | A | * | 5/1989 | Berta |
| 4,841,668 | A | * | 6/1989 | McKenzie |
| 5,109,629 | A | * | 5/1992 | King et al. |
| 5,154,018 | A | * | 10/1992 | Livingston |
| 5,577,687 | A | * | 11/1996 | Downing |
| 5,588,252 | A | * | 12/1996 | Jones |
| 5,678,352 | A | * | 10/1997 | Leitner et al. |

OTHER PUBLICATIONS

M56 Motorized Smoke Obscurant System "TheCoyote", SBCCOM Online, PM–Obscuration & Decontamination: M56 Coyote available at—http://www.apgea.army.mil/products/m56.htm.

M58 Wolf Smoke Generator System, Military Analysis Network, M58A3 Wolf Smoke Generator Carrier available at—http://www.fas.org/man/dod–101/sys/land/m58.htm.

Light Vehicle Obscuration Smoke System (LVOSS), SBCCOM Online, PM–Obscuration & Decontamination available at http://www.apgea.army.mil/products/lvoss.htm.

M157A2 Smoke Generator Set & M1059/M1059A3 smoke Generator Carrier "The LYNX" available at http://www.apgea.army.mil/products/m157a2.htm.

* cited by examiner

*Primary Examiner*—Charles T. Jordan
*Assistant Examiner*—T. Dinh

(57) ABSTRACT

The present invention provides a WARren Portal IDentification and tunnel resident disgorger System (WARPIDS) comprising a jet engine, a marker medium and a base. In a preferred embodiment, the jet engine is configured to create an engine exhaust that is aimable into a first portal of a warren, perhaps having a plurality of interconnecting tunnels. The engine exhaust thereby creates an overpressure within the warren such that the engine exhaust escapes from a second tunnel portal. The marker medium is coupleable to, and configured to flow with, the engine exhaust from the first tunnel portal and through the second tunnel portal thereby marking the second tunnel portal. The base, coupled to and supporting the jet engine, is configured to be transported and located proximate the first tunnel portal by a conventional aircraft.

22 Claims, 2 Drawing Sheets

WARREN PORTAL IDENTIFICATION AND TUNNEL RESIDENT DISGORGER SYSTEM

TECHNICAL FIELD OF THE INVENTION

The present invention is directed, in general, to a conventional war device and, more specifically, to a combination warren portal identification and tunnel resident disgorger system.

BACKGROUND OF THE INVENTION

For many centuries one of the most difficult tasks that an army must face is in ferreting out enemy soldiers who are holed up in caves, tunnels and the like. During the latter months of World War II, American soldiers and Marines, supported by naval bombardment, assaulted numerous Pacific islands that were held by the Japanese Army. In some cases, the islands en route to Japan were bypassed rather than expend manpower and materiel to extract or kill Japanese soldiers who were firmly entrenched in the caves of the islands. However, because of its size and location, the island of Okinawa Jima could not be bypassed, but must be taken in bitter face to face combat with the entrenched enemy. The tools of the time available to soldiers for close in combat of this type were typically limited to small arms, grenades and flame throwers. Naval bombardment could only do so much to soften up these emplacements. Each cave, pill box or other emplacement had to be individually secured by ground troops in close in fighting. Small arms, grenades and flame throwers have a relatively small area of effect when used to assault a cave. As a result, casualties were high, but the price was paid. Soldiers so entrenched can hold out for years. As late as 1974, Hiroo Onoda, a former World War II Japanese Imperial Army officer, finally responded to his former commanding officer's entreaty and came out of hiding, having been holed up on Lubang Island of the Philippines.

Again during the Vietnam War, the North Vietnamese Army and Viet Cong, as well as enemy saboteurs, used natural or seemingly natural, caves and tunnels to hide men, communications headquarters, materiel, etc. To counter this threat, the US Army used tunnel rats, i.e., soldiers specially trained to crawl single file into these lairs and confront the enemy one-to-one under extremely dangerous circumstances. Despite the many long years of fighting the Vietnam War, no system was ever developed that was able to successfully identify the myriad of openings that the Viet Cong had developed for their tunnel system. Not until normalization of relations with the reunited Vietnam was any idea of the extent of the South Vietnam tunnel system ever truly understood.

Today, the United States and its allies are facing a terrorist enemy who hides in a distant foreign country with formidable mountainous terrain involving numerous caves, many of which are interconnected forming a warren. The enemy, therefore, has the potential advantage of being able to wait out military assaults by hiding deep within a mountain, safe from virtually all conventional weapons. Very expensive bunker buster bombs may have some effect on closing some of these caves, however the number of caves and alternative exits makes this impractical on a large scale. Thus, the ability of enemy soldiers to use natural or man-made warrens enables them to significantly delay completion of a military operation and endangers soldiers and the populace at large.

Accordingly, what is needed in the art is a highly efficient, air transportable system that: (a) enables identification of the numerous portals of a cave warren so that the portals can be individually closed and (b) physically and psychologically encourages enemy residents in the caves to seek escape from the warren where they can then be captured or eliminated.

SUMMARY OF THE INVENTION

To address the above-discussed deficiencies of the prior art, the present invention provides a WARren Portal IDentification and tunnel resident disgorger System (WARPIDS), comprising: a jet engine, a marker medium and a base.

In a preferred embodiment, the jet engine is configured to create an engine exhaust that is aimable into a first portal of a warren, perhaps one having a plurality of interconnecting tunnels. The engine exhaust creates an overpressure within the warren such that the engine exhaust travels through at least some of the warren and escapes from a second tunnel portal. The marker medium is coupleable to, and configured to flow with, the engine exhaust from the first tunnel portal and through the second tunnel portal thereby marking the second tunnel portal. The base, coupled to and supporting the jet engine, is configured to be transported and located proximate the first tunnel portal by a conventional aircraft.

In one embodiment, the WARPIDS further comprises a ground anchor system coupled to the base and configured to restrain the base and the jet engine when the jet engine is operated at a maximum power. In another embodiment, the marker medium is an oil or smoke agent. The marker medium, in another embodiment, further comprises an anti-personnel chemical agent.

In another embodiment, the jet engine further comprises a pyrotechnic device coupleable to the jet engine and configured to start the jet engine. In yet another embodiment, the WARPIDS further comprises a starter engine startable from a battery and coupleable to the jet engine, wherein the starter engine is configured to start the jet engine.

In one embodiment, the WARPIDS further comprises an expendables pallet configured to retain and supply expendables to the jet engine and wherein the expendables comprise a quantity of jet fuel and the marker medium. In a further aspect, the expendables pallet further comprises quick connects coupleable to the jet engine and configured to convey the expendables to the jet engine. In another embodiment, the conventional aircraft is a helicopter.

In one embodiment, the WARPIDS further comprises a chute coupleable to the engine exhaust and configured to dispense a plurality of projectiles into engine exhaust and thence into the warren. In yet another embodiment, the WARPIDS further comprises an acoustic amplifier coupleable to the engine exhaust and configured to cause an audible sound of high intensity in the warren.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
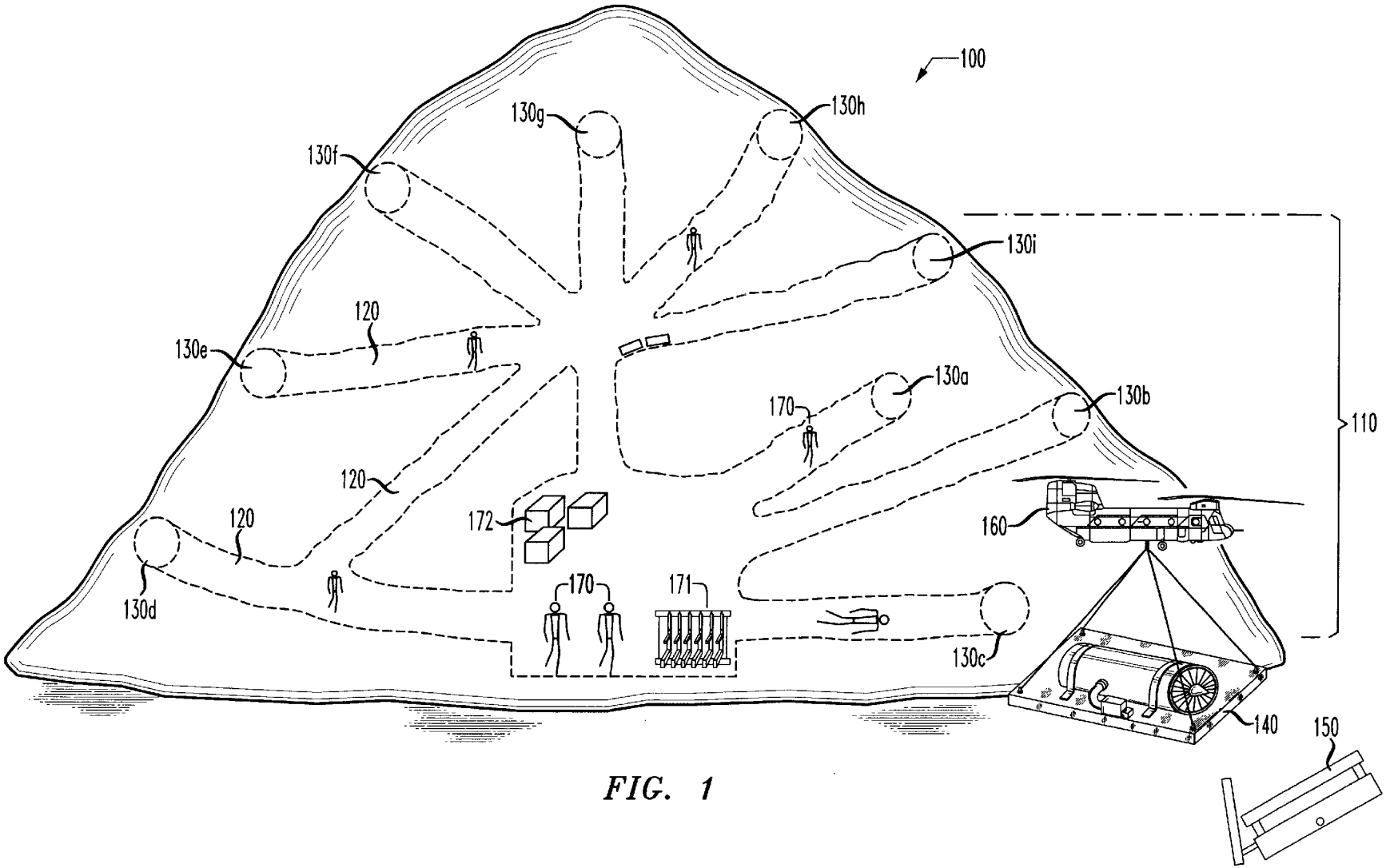
FIG. 1 illustrates a schematic diagram of a typical mountain having a warren comprised of a plurality of interconnecting tunnels and a plurality of warren portals with a Forward Operating Base and a WARren Portal IDentification and tunnel resident disgorger System (WARPIDS) constructed according to the principles of the present invention.

Referring initially to FIG. 1, illustrated is a schematic diagram of a typical mountain 100 having a warren 110 comprised of a plurality of interconnecting tunnels 120 and a plurality of warren portals 130*a*–130*i*, collectively designated 130, with a Forward Operating Base 150 and a WARren Portal IDentification and tunnel resident disgorger System (WARPIDS) 140 constructed according to the principles of the present invention. Considering that the mountain 100 may comprise several square miles of surface area that would have to be individually searched for the portals 130, the plurality of tunnels 120 provides an excellent hiding location for a multitude of enemy terrorists 170, their arms 171 and supplies 173. In conventional warfare, once a single portal, e.g., 130*c*, has been found, ground forces would have to decide whether or not to enter the portal 130*c* and proceed to try to find their way through the warren 110 and find each of the other portals 130*a*, 130*b*, 130*d*–130*h*. During this time, the enemy terrorists 170 would generally have the advantage of being familiar with the layout of the warren 110 as well as having time to find at least one of the other portals 130*a*, 130*b*, 130*d*–130*h* that allows them to escape. If the escape portal 130*a*, 130*b*, 130*d*–130*h* is on the far side of the mountain 100 as in the case of portals 130*a*, 130*b*, 130*d* and 130*f*, a sufficient number of friendly ground forces may not exist to assure that the enemy terrorists 170 do not escape while the search is ongoing.

Once ground troops have located any portal, e.g., 130*c*, airlift 160 is called by radio to deliver the WARPIDS 140 to the selected portal 130*c* of the warren 110. Because of the method of operation of the WARPIDS 140, it is not critical which portal 130*a*–130*i* is chosen—any portal 130*a*–130*i* suffices. In a preferred embodiment, the WARPIDS 140 is a palletized system deliverable by inter-theater heavy airlift, e.g., C-130, C-5, C-17, to the Forward Operating Base (FOB) 150. At the FOB 150, the WARPIDS 140 is coupleable to a suitable helicopter 160, other aircraft or ground vehicle that then transports the WARPIDS 140 to the selected portal 130*c*.

Figure 2:
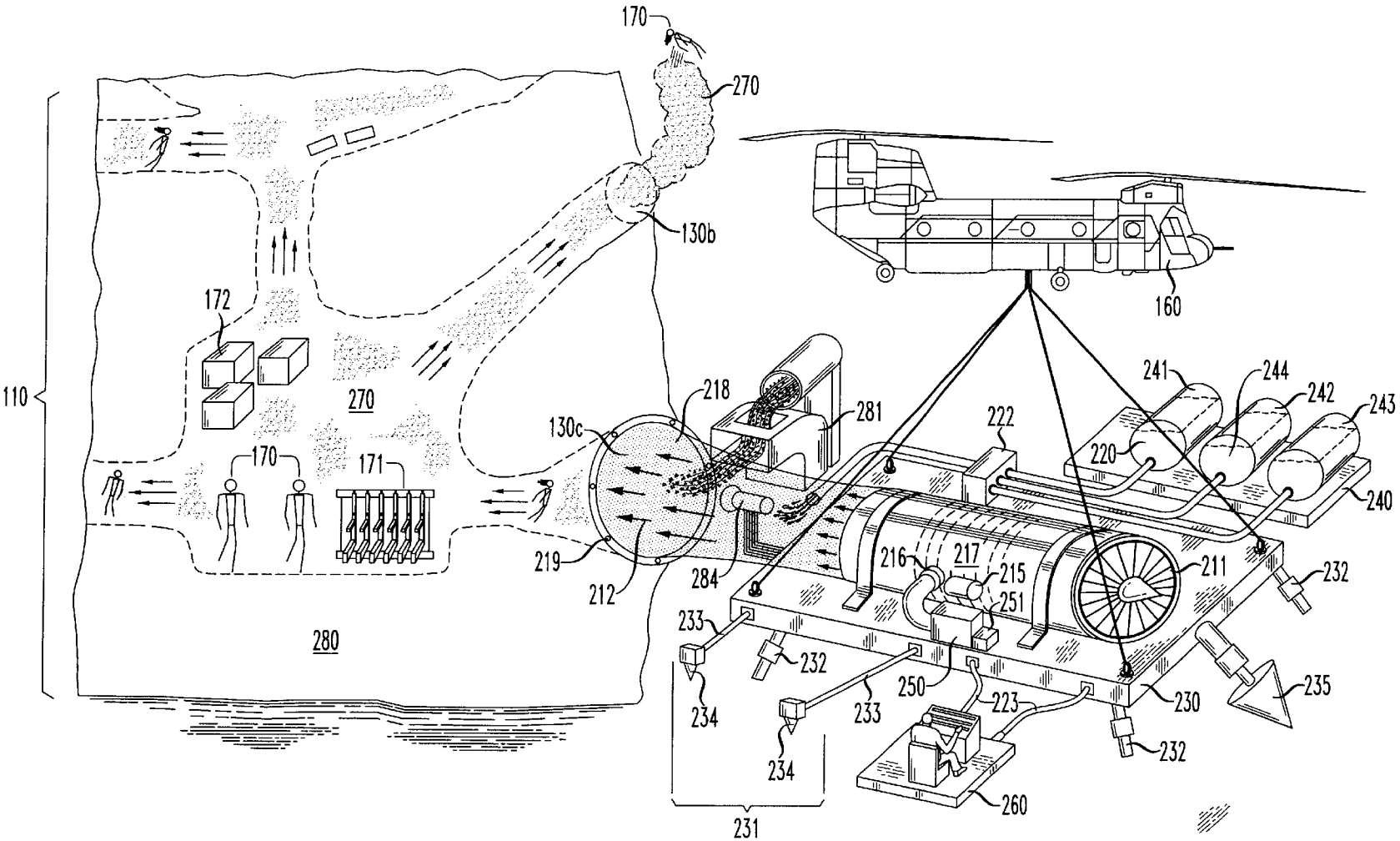
FIG. 2 illustrates a perspective view of the WARPIDS and a portion of the warren of FIG. 1.

Referring now to FIG. 2, illustrated is a perspective view of the WARPIDS 140 and a portion of the warren 110 of FIG. 1. The WARPIDS 140 comprises a jet engine 210, a marker medium 220, a base 230, an expendables pallet 240 and a control console 260. The base 230, coupled to and supporting the jet engine 210, is configured to be transported and located proximate the first tunnel portal 130*c* by conventional aircraft 160. In a preferred embodiment, the conventional aircraft is a helicopter 160. In a preferred embodiment, the jet engine 210 has an engine inlet 211 and an engine exhaust 212. The control console is coupleable to the base 230 with quick connects 223 that enable an operator seated at the console 260 to control the operation of the WARPIDS 140.

The base 230 has a ground anchoring system 231 that may include: (a) adjustable pneumatic or hydraulic struts 232, (b) a mooring device 233 that is coupleable to the ground 280 or (c) a compaction cone 235 to resist forward movement. The mooring device 233 may be equipped with rapid attachment devices, e.g., pyrotechnic-activated pitons 234 that can be explosively coupled to the ground 280. The compaction cone 235 is hydraulically adjustable to position the cone 235 so that it digs into the ground 280 under the strain of the operating engine 210, thereby resisting motion of the engine 210 and base 230 assembly.

The jet engine 210 may be any of several types, however, it should have a significant throughflow of air so that an overpressure can be generated in the warren 110. Some types that should be readily available in surplus storage and which are generally suitable include the J57 and J79. An afterburner-equipped engine is not generally desirable because of the high fuel consumption associated therewith. A thrust reverser-equipped aircraft is likewise undesirable, as a thrust reverser is only added weight. The jet engine 210 is configured so that the engine exhaust 212 is aimable into the selected portal 130*c*. In one embodiment, hydraulic or pneumatic struts 232 are coupled to the base 230 and adjusted for proper orientation of the base 230 when the engine 210 has been started. The engine auxiliary hydraulic or pneumatic systems (not specifically shown) may be used to adjust the struts 232. Alternatively, the engine 210 may be equipped with a flexible exhaust nozzle (not shown) that is hydraulically controlled. One skilled in the pertinent art will readily devise other systems with which to aim the exhaust 212.

The engine 210 may also be equipped with an inlet nozzle (not shown, but like those found on Boeing 727s or Lockheed L-1011s), that serves to separate the intake from the ground beneath. This can advantageously protect the engine from foreign object damage (FOD).

In one embodiment, the engine 210 is equipped with a pyrotechnic starter device 215 that is coupled to the engine turbine 217; thereby offering rapid self-contained start capability. Many J-57-P/F-43WB and J-57-P/F-59WP engines, having been removed and replaced with the conversion of KC-135A airframes to KC-135R aircraft, should be available with this feature already installed. These engines are static rated in the 11,200-pound class without auxiliary water injection which is not required for this application. Alternatively, a jet engine starter unit 250 may be coupled to the base 230 and to the engine 210. A typical jet engine starter unit 250 employs a J-69 jet engine that is startable with a battery 251, and puts out sufficient exhaust that, when routed through a pneumatic starter 216 of the jet engine 210 causes sufficient rotation of the jet engine turbine 217 to enable starting the jet engine 210. The jet engine 210 should further comprise a forcing cone 218 coupleable to an area around the portal 310*c* at coupling points 219. These coupling points 219 may be configured to be installed with pyrotechnic devices to speed installation.

The expendables pallet 240 comprises a marker medium tank 241, a chemical agent tank 242 and a jet fuel tank 243. A quick connect manifold 222 is coupled to the base 230 and provides a rapid setup capability to route the contents of the marker medium tank 241, chemical agent tank 242 and jet fuel tank 243. The marker medium 220 may be any liquid suitable for making a large amount of smoke when introduced into the engine exhaust 212. Oil is one such agent. Additionally, the marker medium 220 may be treated with coloring chemicals such as those used by aerial demonstration teams to inject into an aircraft exhaust stream to create colored smoke. One who is skilled in the art is familiar with these chemicals. The marker medium 220 is intended to create enough smoke 270 when introduced into the engine exhaust 212 that the smoke 270 is carried through the warren 110 to every portal 130. As the smoke 270 escapes from each of the portals 130, the smoke 270 identifies the portal location as the smoke 270 escapes into the atmosphere. Coloring the smoke 270, as mentioned above, may be used to further assist in differentiating between environmental dust and the smoke 270 exiting a portal 230.

Running the jet engine 210 at idle (about 70% of limit N1 turbine speed) creates a significant volumetric flow of exhaust gases including significant quantities of carbon dioxide $CO_2$ and carbon monoxide CO. These gases, CO and $CO_2$, displace the oxygen that the terrorists 170 require to breathe. Carbon monoxide is also deadly, and will quickly contribute to incapacitation and potentially death of the terrorists 170. Running the jet engine 210 at cruise power (about 85% to 90% of limit N1 turbine speed) creates an overpressure in the warren 110 that causes the jet engine exhaust gases and smoke 270 to find every corner of the warren 110 until the smoke 270 exits through some portal, for example portal 130*b*. This also causes significant airflow and force to be applied to those persons and objects in the warren 110. Therefore, the terrorists 170 are assaulted through their sense of touch as they are blown about in the warren. Even if the velocity of the exhaust gases and smoke 270 deep in the warren is not high enough to throw persons or items about, the smoke and fumes have a choking effect on the terrorists 170. The engine exhaust gases create an overpressure within the warren 110 such that the engine exhaust gases and smoke 270 escape from a second tunnel portal, e.g., portal 130*b*. The marker medium 220 is coupleable to, and configured to flow with, the engine exhaust gases 270 from the first tunnel portal 130*c* and through the second tunnel portal 130*h*, thereby marking the second tunnel portal 130*b*.

The chemical agent tank 242 contains a quantity of anti-personnel chemical agent 244 that may include conventional incapacitating agents, such as tear agents CS or CN. However, these will probably disperse too quickly under the pressure of the jet exhaust, and alternatively, other noxious chemicals such as ammonium hydroxide, household bleach or other similar chemicals may be used. These chemicals are particularly suitable because they are inexpensive and readily available. The anti-personnel chemical agent 244 is used to assault the olfactory and taste senses, and ocular membranes, thereby encouraging those terrorists 170 that encounter the chemicals 244 to exit the warren 110 at the nearest portal 130. However, because of the overpressure caused by the jet engine 210, the exhaust gases will carry the marker medium 220 through the warren 110 and expose the portals 130 faster than any individual terrorist 170 can run or crawl through the warren 110. In President George W. Bush's words, we will literally "Smoke them out and get them running." Even if a terrorist 170 is within the warren 110 and close to one of the portals 130, exiting the warren 110 does not necessarily save him. If a terrorist 170 succeeds in escaping the warren 110, he will find himself in the open and subject to the military action of armed forces. As soon as the smoke identifies a particular portal 130, friendly forces will endeavor to close that particular portal 130 with air strikes, artillery, grenades or explosives.

The WARPIDS 140 further comprises a hopper 281 coupleable to the engine exhaust 212 and configured to accept and dispense a plurality of projectiles 282 into the engine exhaust gases 270. The plurality of projectiles 282 may be a variety of objects including, but not limited to, sand, nut shells, broken glass or sharp plastic fragments. The plurality of projectiles 282 are carried by the engine exhaust gases 270 into the warren 110, causing the terrorists to experience additional physical hazards to their sense of touch from the projectiles 282 flying into the tunnels 120 at very high speeds.

Although the jet engine models suggested above are significantly loud in their own right, the WARPIDS 140, in a preferred embodiment, further comprises an acoustic amplifier 284 coupleable to the engine exhaust 212. The acoustic amplifier 284 may be a pneumatic horn or whistle-type device that is configured (perhaps by means of a hyperbolic shape) to cause or amplify an audible sound of very high intensity in the warren 110 thereby assaulting the auditory channel of the terrorists 170. Because of the power of the jet engine 210, enormous energy can be imparted to the acoustic amplifier 284. Thus, terrorists 170 in the warren 110 are captive to an audible assault of tremendous magnitude, further encouraging the terrorists 170 to exit the warren 110 at their first opportunity.

While the present invention has been described as a palletized system, WARPIDS 140 could also be placed on a suitable motorized vehicle, most probably a tracked or half-tracked vehicle, so that it can be maneuvered once located near a portal 130. In that case, the control console 260 could be integrally coupled to the vehicle and the expendables be provided on a separate motorized vehicle while still being air transportable.

Thus, a system has been described that: (a) marks all portals of a terrorists' warren with smoke carried through the warren by the exhaust of a jet engine and (b) includes provisions for assaulting all five of the terrorists' senses thereby encouraging them to exit the warren at the earliest possible opportunity. In some instances, slowness on the part of the terrorists may actually result in their death.

Although the present invention has been described in detail, those skilled in the art should understand that they can make various changes, substitutions and alterations herein without departing from the spirit and scope of the invention in its broadest form.

What is claimed is:

1. A WARren Portal IDentification and tunnel resident disgorger System (WARPIDS), comprising:

a jet engine configured to create an engine exhaust that is aimable into a first portal of a warren, said engine exhaust creating an overpressure within said warren such that said engine exhaust escapes from a second portal;

a marker medium coupleable to and configured to flow with said engine exhaust from said first tunnel portal and through said second tunnel portal thereby marking said second tunnel portal; and a base, coupled to and supporting said jet engine, configured to be transported and located proximate said first tunnel portal by a conventional aircraft.

2. The WARPIDS as recited in claim 1 further comprising a ground anchor system coupled to said base and configured to restrain said base and said jet engine when said jet engine is in operation.

3. The WARPIDS as recited in claim 1 wherein said marker medium is an oil or a smoke agent.

4. The WARPIDS as recited in claim 1 wherein said marker medium further comprises an anti-personnel chemical agent.

5. The WARPIDS as recited in claim 1 wherein said jet engine further comprises a pyrotechnic device coupleable to said jet engine and configured to start said jet engine.

6. The WARPIDS as recited in claim 1 further comprising a starter engine startable from a battery and coupleable to said jet engine, said starter engine configured to start said jet engine.

7. The WARPIDS as recited in claim 1 further comprising an expendables pallet configured to retain and supply expendables to said jet engine and wherein said expendables comprise a quantity of jet fuel and said marker medium.

8. The WARPIDS as recited in claim 7 wherein said expendables pallet further comprises quick connects coupleable to said jet engine and configured to convey said expendables to said jet engine.

9. The WARPIDS as recited in claim 1 wherein said conventional aircraft is a helicopter.

10. The WARPIDS as recited in claim 1 further comprising a hopper coupleable to said engine exhaust and configured to dispense a plurality of projectiles into said engine exhaust and thence into said warren.

11. The WARPIDS as recited in claim 1 further comprising an acoustic amplifier coupleable to said engine exhaust and configured to cause an audible sound of high intensity in said warren.

12. A method of manufacturing a WARren Portal IDentification and tunnel resident disgorger System (WARPIDS), comprising:

configuring a jet engine to create an engine exhaust that is aimable into a first portal of a warren, said engine exhaust creating an overpressure within said warren such that said engine exhaust escapes from a second portal;

coupling a marker medium to said engine exhaust and configuring said marker medium to flow with said engine exhaust from said first tunnel portal and through said second tunnel portal thereby marking said second tunnel portal; and coupling a base to said jet engine, said base supporting said jet engine and configured to be transported and located proximate said first tunnel portal by a conventional aircraft.

13. The method as recited in claim 12 further comprising coupling a ground anchor system to said base, said ground anchor system configured to restrain said base and said jet engine when said jet engine is in operation.

14. The method as recited in claim 12 wherein coupling a marker medium includes coupling a marker medium comprising an oil or a smoke agent.

15. The method as recited in claim 12 wherein coupling a marker medium includes coupling a marker medium further comprising an anti-personnel chemical agent.

16. The method as recited in claim 12 wherein configuring a jet engine includes configuring a jet engine further comprising a pyrotechnic device coupleable to said jet engine and configured to start said jet engine.

17. The method as recited in claim 12 wherein configuring a jet engine includes configuring a jet engine further comprising a starter engine startable from a battery and coupleable to said jet engine, said starter engine configured to start said jet engine.

18. The method as recited in claim 12 further comprising configuring an expendables pallet to retain and supply expendables to said jet engine and wherein said expendables comprise a quantity of jet fuel and said marker medium.

19. The method as recited in claim 18 wherein configuring an expendables pallet includes configuring an expendables pallet further comprising quick connects coupleable to said jet engine and configured to convey said expendables to said jet engine.

20. The method as recited in claim 12 wherein coupling a base includes coupling a base wherein said conventional aircraft is a helicopter.

21. The method as recited in claim 12 wherein configuring a jet engine includes configuring a jet engine further comprising a hopper coupleable to said engine exhaust and configured to dispense a plurality of projectiles into said engine exhaust and thence into said warren.

22. The method as recited in claim 12 wherein configuring a jet engine includes configuring a jet engine further comprising an acoustic amplifier coupleable to said engine exhaust and configured to cause an audible sound of high intensity in said warren.

* * * * *